US010672539B2

(12) United States Patent
Kim et al.

(10) Patent No.: US 10,672,539 B2
(45) Date of Patent: Jun. 2, 2020

(54) POWER CABLE

(71) Applicant: LS CABLE & SYSTEM LTD., Anyang-si, Gyeonggi-do (KR)

(72) Inventors: Ji Sung Kim, Suwon-si (KR); Weon Bae Kim, Gangneung-si (KR); Kyoung Ro Ko, Daegu (KR); Su Kil Lee, Gangneung-si (KR); Joon Keun Lee, Seoul (KR); Soon Il Sohn, Gunpo-si (KR); Kum Hwan Cha, Anyang-si (KR); Jae Cheol Gwag, Daegu (KR); Tae Hyun Kim, Seoul (KR)

(73) Assignee: LS CABLE & SYSTEM LTD., Anyang-Si, Gyeonggi-do (KR)

( * ) Notice: Subject to any disclaimer, the term of this patent is extended or adjusted under 35 U.S.C. 154(b) by 0 days.

(21) Appl. No.: 16/495,261

(22) PCT Filed: Mar. 30, 2017

(86) PCT No.: PCT/KR2017/003519
§ 371 (c)(1),
(2) Date: Sep. 18, 2019

(87) PCT Pub. No.: WO2018/174330
PCT Pub. Date: Sep. 27, 2018

(65) Prior Publication Data

US 2020/0013526 A1 Jan. 9, 2020

(30) Foreign Application Priority Data

Mar. 24, 2017 (KR) ..... 10-2017-0037449

(51) Int. Cl.
*H01B 9/02* (2006.01)
*H01B 3/30* (2006.01)
(Continued)

(52) U.S. Cl.
CPC ..... *H01B 9/02* (2013.01); *H01B 3/20* (2013.01); *H01B 3/30* (2013.01); *H01B 7/0225* (2013.01);
(Continued)

(58) Field of Classification Search
None
See application file for complete search history.

(56) References Cited

U.S. PATENT DOCUMENTS 2,709,197 A * 5/1955 Davey ..... H01B 7/0241 174/25 R
2,914,429 A * 11/1959 King ..... H01B 3/20 427/120
(Continued)

FOREIGN PATENT DOCUMENTS

JP 2005346981 A 12/2005
JP 2015118840 A 6/2015
(Continued)

OTHER PUBLICATIONS

International Search Report for related International Application No. PCT/KR2017/003519; report dated Aug. 27, 2018; (3 pages).
(Continued)

*Primary Examiner* — Timothy J Thompson
*Assistant Examiner* — Muhammed Azam
(74) *Attorney, Agent, or Firm* — K&L Gates LLP

(57) ABSTRACT

A power cable includes a conductor; an inner semi-conductive layer covering the conductor; an insulating layer covering the inner semi-conductive layer, the insulating layer being impregnated with an insulating oil; an outer semi-conductive layer covering the insulating layer; a metal sheath layer covering the outer semi-conductive layer; and a cable protection layer covering the metal sheath layer. The insulating layer is formed by cross-winding insulating paper
(Continued)

and impregnating the insulating paper with the insulating oil. The inner semi-conductive layer and the outer semi-conductive layer are formed by cross-winding semi-conductive paper and impregnating the semi-conductive paper with the insulating oil. A thickness of the outer semi-conductive layer is 7.5 to 15% of a total thickness of the inner semi-conductive layer, the insulating layer, and the outer semi-conductive layer.

16 Claims, 3 Drawing Sheets

(51) Int. Cl.

| | |
|---|---|
| ***H01B 3/20*** | (2006.01) |
| ***H01B 9/06*** | (2006.01) |
| ***H01B 7/14*** | (2006.01) |
| ***H01B 7/20*** | (2006.01) |
| ***H01B 7/02*** | (2006.01) |

(52) U.S. Cl.
CPC ..... *H01B 7/14* (2013.01); *H01B 7/20* (2013.01); *H01B 9/0688* (2013.01); *H01B 9/0694* (2013.01)

(56) References Cited

U.S. PATENT DOCUMENTS

| | | | | | |
|---|---|---|---|---|---|
| 3,651,244 | A * | 3/1972 | Silver | H01B 9/022 | 174/36 |
| 4,237,334 | A * | 12/1980 | Kojima | B32B 27/10 | 174/25 R |
| 4,329,536 | A * | 5/1982 | Sato | H01B 3/22 | 174/250 |
| 4,417,093 | A * | 11/1983 | Occhini | H01B 3/20 | 174/102 SC |
| 4,602,121 | A * | 7/1986 | Priaroggia | H01B 7/14 | 174/25 R |
| 4,853,490 | A * | 8/1989 | Bosisio | H01B 3/008 | 174/25 R |
| 6,201,191 | B1 * | 3/2001 | Yorita | H01B 9/0688 | 174/110 R |
| 6,383,634 | B1 * | 5/2002 | Kornfeldt | H01B 3/20 | 428/379 |
| 9,853,438 | B2 * | 12/2017 | Chae | H01B 9/027 | |
| 10,128,026 | B2 * | 11/2018 | Na | H01B 1/02 | |
| 10,210,967 | B2 * | 2/2019 | Lee | H01B 7/28 | |
| 2001/0042635 | A1 * | 11/2001 | Kondo | H01B 3/22 | 174/110 R |
| 2010/0186988 | A1 * | 7/2010 | Jeroense | H01B 7/045 | 174/103 |
| 2010/0206616 | A1 * | 8/2010 | Motoi | H01H 13/08 | 174/25 R |
| 2012/0080213 | A1 * | 4/2012 | Furuheim | H01B 7/28 | 174/106 R |
| 2012/0285725 | A1 * | 11/2012 | Maritano | H01B 3/52 | 174/120 FP |
| 2017/0012371 | A1 * | 1/2017 | Chae | H01R 4/68 | |
| 2018/0025810 | A1 * | 1/2018 | Ko | H01B 3/48 | 174/105 R |
| 2018/0226176 | A1 * | 8/2018 | Marelli | H01B 7/14 | |
| 2019/0057794 | A1 * | 2/2019 | Jung | H01B 7/2825 | |
| 2020/0013526 | A1 * | 1/2020 | Kim | H01B 9/0688 | |

FOREIGN PATENT DOCUMENTS

| | | |
|---|---|---|
| KR | 1020150126736 | 11/2015 |
| KR | 20160101643 A | 8/2016 |
| KR | 20160121873 A | 10/2016 |

OTHER PUBLICATIONS

Written Opinion for related International Application No. PCT/KR2017/003519; report dated Aug. 27, 2018; (3 pages).

* cited by examiner

POWER CABLE

CROSS-REFERENCE TO RELATED APPLICATIONS

The present application is a National Stage of International Application No. PCT/KR2017/003519, filed Mar. 30, 2017, which claims priority to Korean Application No. 10-2017-0037499, filed Mar. 24, 2017, the disclosure of which are incorporated herein by reference.

TECHNICAL FIELD

The present invention relates to a power cable, particularly, an ultra-high voltage underground or submarine cable for long-distance direct-current transmission. More specifically, the present invention relates to a power cable, in which an insulating layer has high dielectric strength, an electric field applied to the insulating layer is effectively reduced, and particularly, a large void is suppressed from occurring in the insulating layer when the power cable is left at low temperatures for a long time until electric current is supplied thereto after installed in a low-temperature environment, thereby effectively preventing partial discharge, dielectric breakdown, etc. from occurring due to an electric field concentrated in the large void.

BACKGROUND ART

Power cables employing a polymeric insulator, such as cross-linked polyethylene (XLPE), as an insulating layer have been used. However, due to space charges formed at a high direct-current (DC) electric field, paper-insulated cables having an insulating layer formed by impregnating insulating paper, which is cross-wound to cover a conductor, etc., with an insulating oil have been used as ultra-high voltage DC transmission cables.

Examples of the paper-insulated cables include an oil-filled (OF) cable in which A low-viscosity insulating oil is circulated, a mass-impregnated non-draining (MIND) cable impregnated with a high or medium viscosity insulating oil, and the like. The OF cable is limited in terms of a length of transmission of a hydraulic pressure for circulation of the insulating oil and thus is not suitable as a long-distance transmission cable. Particularly, the OF cable is difficult to install insulating-oil circulation facility at the sea bottom and thus is not suitable as a submarine cable.

Accordingly, the MIND cable is generally used as a long-distance DC transmission cable or an ultra-high voltage submarine cable.

In the MIND cable, an insulating layer is formed by winding insulating paper in a plurality of layers. For example, either Kraft paper or semi-synthetic paper formed by stacking kraft paper and thermoplastic resin such as polypropylene resin may be used as the insulating paper.

In the case of a cable in which only kraft paper is wound and impregnated with an insulating oil, when the cable is operated (when an electric current is supplied to the cable), a temperature change occurs inwardly in a radial direction, i.e., outwardly from a portion of the insulating layer adjacent to an inner semi-conductive layer, i.e., toward an outer semi-conductive layer outside the insulating layer, due to heat generated due to a joule loss due to the electric current flowing through a conductor of the cable.

Accordingly, the viscosity of the insulating oil in the portion of the insulating layer adjacent to the inner semi-conductive layer having relatively high temperature decreases and thus the insulating oil thermally expands and moves to a portion of the insulating layer adjacent to the outer semi-conductive layer. In contrast, when the temperature of the cable decreases, the viscosity of the moving insulating oil increases but does not return to the original position. Thus, deoiling voids may occur inwardly in the radial direction, i.e., in the portion of the insulating layer adjacent to the inner semi-conductive layer, due to thermal contraction the insulating oil.

In addition, when the cable is operated (when an electric current is supplied to the cable), the viscosity of the impregnated insulating oil decreases due to heat generated due to joule loss caused by the electric current flowing through the conductor of the cable and thus the insulating oil thermally expands and moves from a portion of the cable installed at a higher position to a portion of the cable installed at a lower position. When the temperature of the cable decreases, the viscosity of the moving insulating oil increases but does not return to the original position and thus deoiling voids may occur due to the thermal contraction of the insulating oil.

Because no insulating oil is contained in the deoiling voids, an electric field may be concentrated in the deoiling voids and thus partial discharge, dielectric breakdown, or the like may occur starting from the deoiling void, thereby decreasing the lifespan of the cable.

However, when the insulating layer is formed using semisynthetic paper, the insulating oil may be suppressed from flowing due to the thermal expansion of thermoplastic resin, such as polypropylene resin, which is not impregnated with oil during the operation of the cable. In addition, because an insulation resistance of polypropylene resin is higher than that of Kraft paper, a voltage shared by polypropylene may be decreased even when deoiling voids occur.

Because the insulating oil does not move in polypropylene resin, the flow of the insulating oil in a diameter direction of the cable may be suppressed due to gravity. Furthermore, surface pressure is applied to the kraft paper due to thermal expansion of the polypropylene resin at an impregnation temperature during the manufacture of the cable or at an operating temperature during the operation of the cable and thus the flow of the insulating oil may be further suppressed.

However, even if the occurrence of deoiling voids due to the flow of the insulating oil is suppressed as describe above, an insulating oil impregnated in an insulating layer, a semi-conductive layer and the like may shrink and thus a large number of deoiling voids may occur in the insulating layer and the like, when a MIND cable is installed in a low-temperature environment and used as a underground cable or a submarine cable in an extreme situation. In particular, a force may be applied to the insulating oil in the direction of gravity for a long time until electric current is supplied to the cable after the installation of the cable and thus the insulating oil may move toward the bottom of the cable. Thus, a large void is likely to occur at the top of the cable. Even when the contracting insulating oil expands again due to an increase in a temperature of the insulating layer, etc. by heat generated by a conductor during the operation of the cable, problems such as partial discharge and dielectric breakdown may be caused due to an electric field concentrated in the large void until the large void is removed.

Accordingly, there is an urgent need for a power cable, in which an insulating layer has high dielectric strength, an electric field applied to the insulating layer is effectively reduced, and particularly, a large void is suppressed from occurring in the insulating layer when the power cable is left at low temperatures for a long time until electric current is supplied thereto after installed in a low-temperature environment, thereby effectively preventing partial discharge, dielectric breakdown, etc. from occurring due to an electric field concentrated in the large void.

DETAILED DESCRIPTION OF THE INVENTION

Technical Problem

The present invention is directed to providing a power cable, in which an insulating layer has high dielectric strength and an electric field applied to the insulating layer may be effectively alleviated to increase the lifespan of the cable.

The present invention is also directed to providing a direct-current power cable, in which the occurrence of a large void in an insulating layer may be suppressed to effectively prevent partial discharge, dielectric breakdown, etc. from occurring due to an electric field concentrated in the large void, when the cable is left at low temperatures for a long time until electric current is supplied thereto after installed in a low-temperature environment.

Technical Solution

According to an aspect of the present invention, provided is a power cable comprising: a conductor; an inner semi-conductive layer covering the conductor; an insulating layer covering the inner semi-conductive layer, the insulating layer being impregnated with an insulating oil; an outer semi-conductive layer covering the insulating layer; a metal sheath layer covering the outer semi-conductive layer; and a cable protection layer covering the metal sheath layer, wherein the insulating layer is formed by cross-winding insulating paper and impregnating the insulating paper with the insulating oil, the inner semi-conductive layer and the outer semi-conductive layer are formed by cross-winding semi-conductive paper and impregnating the semi-conductive paper with the insulating oil, and a thickness of the outer semi-conductive layer is 7.5 to 15% of a total thickness of the inner semi-conductive layer, the insulating layer and the outer semi-conductive layer.

According to another aspect of the present invention, provided is the power cable, wherein the thickness of the outer semi-conductive layer is 2 to 4 mm.

According to other aspect of the present invention, provided is the power cable, wherein the insulating oil comprises a medium-viscosity insulating oil having a kinematic viscosity of 5 to 500 centistokes (Cst) at 60° C.

According to other aspect of the present invention, provided is the power cable, wherein the insulating oil comprises a high-viscosity insulating oil having a kinematic viscosity of 500 centistokes (Cst) or more at 60° C.

According to other aspect of the present invention, provided is the power cable, wherein the outer semi-conductive layer comprises: a lower layer formed by cross-winding semi-conductive paper; and an upper layer formed by overlap-winding semi-conductive paper and metallized paper.

According to other aspect of the present invention, provided is the power cable, wherein the outer semi-conductive layer further comprises an uppermost layer formed of woven copper-wire fabric.

According to other aspect of the present invention, provided is the power cable, wherein the insulating layer is formed by sequentially stacking an inner insulating layer, an intermediate insulating layer, and an outer insulating layer, the insulating layer being formed by cross-winding either kraft paper or semi-synthetic paper including a plastic film and kraft paper stacked on at least one side of the plastic film, a thickness of the inner insulating layer is 1 to 10%, a thickness of the intermediate insulating layer is 75% or more, and a thickness of the outer insulating layer is 5 to 15%, based on a total thickness of the insulating layer, and resistivities of the inner insulating layer and the outer insulating layer are less than resistivity of the intermediate insulating layer.

According to other aspect of the present invention, provided is the power cable, wherein the thickness of the outer insulating layer is greater than that of the inner insulating layer.

According to other aspect of the present invention, provided is the power cable, wherein the thickness of the outer insulating layer is 1 to 30 times that of the inner insulating layer.

According to other aspect of the present invention, provided is the power cable, wherein the thickness of the inner insulating layer is 0.1 to 2.0 mm, the thickness of the outer insulating layer is 0.1 to 3.0 mm, and the thickness of the intermediate insulating layer is 15 to 25 mm.

According to other aspect of the present invention, provided is the power cable, wherein a thickness of kraft paper of the inner insulating layer and a thickness of kraft paper of the outer insulating layer are less than a thickness of the kraft paper of the semi-synthetic paper.

According to other aspect of the present invention, provided is the power cable, wherein a maximum impulse electric field value of the inner insulating layer is less than that of the intermediate insulating layer.

According to other aspect of the present invention, provided is the power cable, wherein a maximum impulse electric field value of the intermediate insulating layer is 100 kV/mm or less.

According to other aspect of the present invention, provided is the power cable, wherein a thickness of the plastic film is 40 to 70% of a total thickness of the semi-synthetic paper.

According to other aspect of the present invention, provided is the power cable, wherein the thickness of the semi-synthetic paper is 70 to 200 μm, and a thickness of kraft paper of the inner insulating layer and the outer insulating layer is 50 to 150 μm.

According to other aspect of the present invention, provided is the power cable, wherein the conductor is formed of annealed copper wire or aluminum, and comprises either a flat conductor formed by stacking flat element wires in multiple layers on a round center wire or a circularly compressed conductor formed by stacking and compressing round element wires in multiple layers on a round center wire.

According to other aspect of the present invention, provided is the power cable, wherein the plastic film is formed of a polypropylene homopolymer resin.

Advantageous Effects

In a power cable of the present invention, dielectric strength can be improved due to an insulating layer and semi-conductive layers having specific configurations, and an electric field applied to the insulating layer can be effectively alleviated, thereby achieving an effect of increasing the lifespan of the cable.

In addition, in the power cable of the present invention, a thickness of an outer semi-conductive layer can be precisely adjusted to prevent the occurrence of a large deoiling void in an insulating layer even when an insulating oil impregnated in the cable shrinks and thus partial discharge, dielectric breakdown, etc. may be effectively suppressed from occurring due to an electric field concentrated in the large deoiling void.

MODE OF THE INVENTION

Hereinafter, exemplary embodiments of the present invention will be described in detail. The present invention is, however, not limited thereto and may be embodied in many different forms. Rather, the embodiments set forth herein are provided so that this disclosure will be thorough and complete, and fully convey the scope of the invention to those skilled in the art. Throughout the specification, the same reference numbers represent the same elements.

Figure 1:
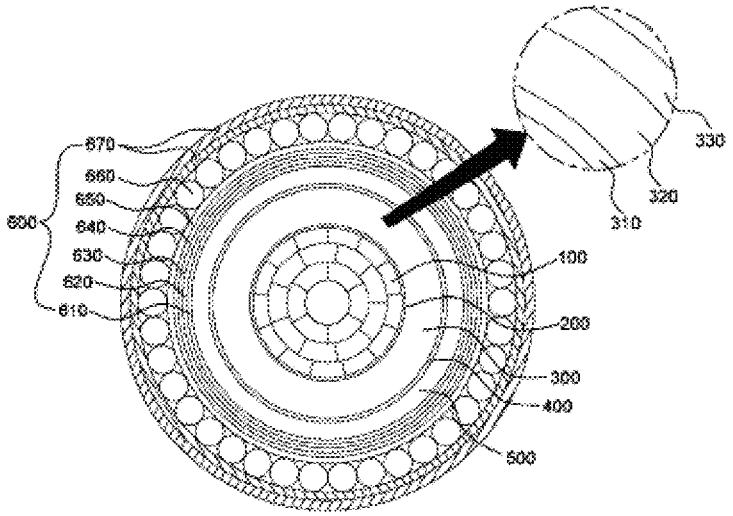
FIG. 1 is a schematic view of a cross section of a power cable according to an embodiment of the present invention.
Figure 2:
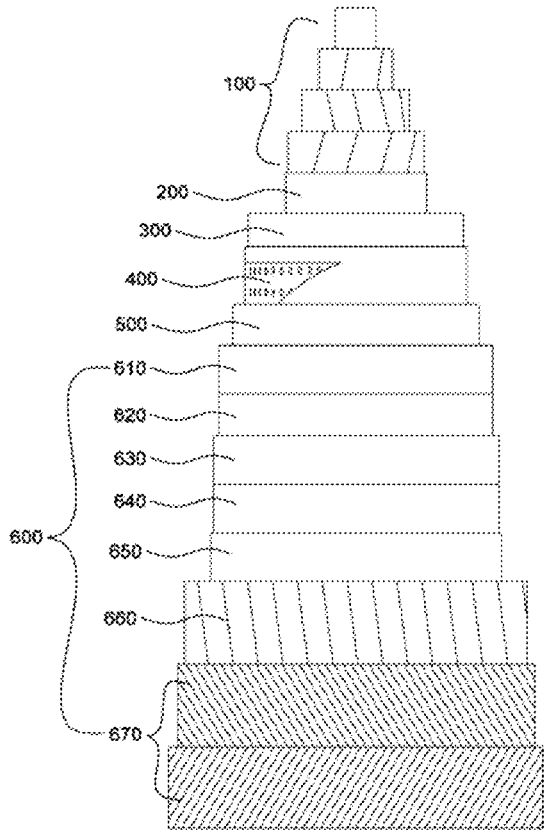
FIG. 2 is a schematic view of a longitudinal section of the power cable of FIG. 1.

FIGS. 1 and 2 are diagrams schematically illustrating a cross section and a longitudinal section of a power cable according to an embodiment of the present invention.

As illustrated in FIGS. 1 and 2, the power cable according to the present invention may include a conductor 100, an inner semi-conductive layer 200 covering the conductor 100, an insulating layer 300 covering the inner semi-conductive layer 200, an outer semi-conductive layer 400 covering the insulating layer 300, a metal sheath layer 500 covering the outer semi-conductive layer 400, a cable protection layer 600 covering the metal sheath layer 500, and the like.

The conductor 100 may serve as a current moving path for transmission of current, and may be formed of high-purity copper (Cu), aluminum (Al), or the like having high conductivity to minimize power loss and having appropriate strength and flexibility to be used as a conductor of the power cable, and particularly, annealed copper wire having high elongation and high conductivity. A cross-sectional area of the conductor 100 may vary according to a power transmission rate, use, etc. of the power cable.

Preferably, the conductor 100 may include a flat conductor formed by stacking flat wires in a plurality of layers on a circular center wire or a circularly compressed conductor formed by stacking round wires in a plurality of layers on a circular center wire and compressing the round wires. The conductor 100 including a flat conductor formed by a so-called keystone method is economical, because an outer diameter of the cable may be reduced due to a high space factor of the conductor 100 and the cross-sectional area of each wire of the conductor 100 may be increased to reduce the total number of wires. In addition, the conductor 100 is effective because there is less void therein and the weight of the insulating oil to be contained in the conductor 100 may be reduced.

The inner semi-conductive layer 200 may suppress distortion and concentration of an electric field due to an irregular surface of the conductor 100 to suppress partial discharge, dielectric breakdown, or the like from occurring between an interface between the inner semi-conductive layer 200 and the insulating layer 300 or due to an electric field concentrated in the insulating layer 300.

The inner semi-conductive layer 200 may be formed by cross-winding semi-conductive paper, e.g., carbon paper obtained by applying a conductive material such as carbon black onto insulating paper or a film formed of a polymer composite material in which a conductive material such as carbon black is dispersed. The inner semi-conductive layer 200 may have a thickness of about 0.2 to 3.0 mm.

The insulating layer 300 is formed by winding insulating paper in a plurality of layers. For example, either kraft paper or semi-synthetic paper formed by stacking kraft paper and thermoplastic resin such as polypropylene resin may be used as the insulating paper.

In an exemplary embodiment of the present invention, the insulating layer 300 may include an inner insulating layer 310, an intermediate insulating layer 320, and an outer insulating layer 330. The inner insulating layer 310 and the outer insulating layer 330 may be formed of a material having lower resistivity than that of a material of the intermediate insulating layer 320. Thus, each of the inner insulating layer 310 and the outer insulating layer 330 may reduce an electric field by preventing a high electric field, which is applied to the cable when the cable is operated, from being applied directly onto the conductor 100 or directly below the metal sheath layer 500, and may suppress deterioration of the intermediate insulating layer 320.

Figure 3:
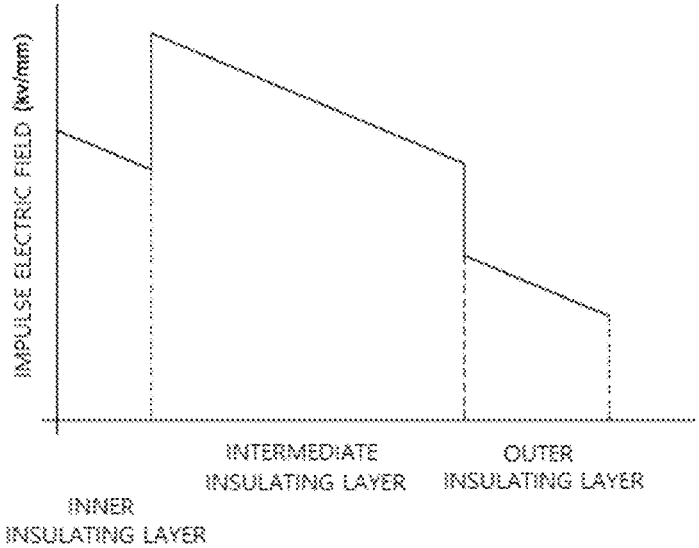
FIG. 3 is a graph schematically showing a process of reducing an electric field in an insulating layer of a power cable according to the present invention.

FIG. 3 is a graph schematically showing a process of reducing an electric field in an insulating layer of a power cable according to the present invention. As illustrated in FIG. 3. a high electric field, which is generally generated in a DC cable, may be effectively suppressed from being applied directly onto the conductor 100 and directly below the metal sheath layer 500 by reducing a DC electric field in the inner insulating layer 310 and the outer insulating layer 330 having relatively low resistivity. In the case of an impulse, a maximum impulse electric field applied to the intermediate insulating layer 320 is controlled to be equal to or less than 100 kV/mm and a high impulse electric field applied to the inner insulating layer 310 may be reduced to suppress deterioration of the inner insulating layer 310. Thus, deterioration of the intermediate insulating layer 320 may be also suppressed. Here, the impulse electric field refers to an electric field applied to the cable when an impulse voltage is applied to the cable.

Therefore, as illustrated in FIG. 3, a maximum impulse electric field value of the inner insulating layer 310 is designed to be less than that of the intermediate insulating layer 320, so that a high electric field may not be applied directly onto the conductor 100 or below the metal sheath layer 500. A maximum impulse electric field applied to the intermediate insulating layer 320 is equal to an internal electric field of the intermediate insulating layer 320. The internal electric field may be controlled to be equal to or less than the maximum impulse electric field, e.g., 100 kV/mm, of the intermediate insulating layer 320, thereby suppressing deterioration of the insulating layer 320.

Accordingly, the entire insulating layer 300 may be made compact by suppressing a high electric field from being applied to the inner insulating layer 310 and the outer insulating layer 330, and particularly, to a cable connection member vulnerable to an electric field, and further maximizing the performance of the intermediate insulating layer 320. The deterioration of the insulating layer 300 may be suppressed to prevent deterioration of dielectric strength and other physical properties thereof. Therefore, a compact cable having an impulse internal pressure higher than a voltage of a general cable may be achieved and shortening of the lifespan of the cable may be suppressed.

According to an embodiment of the present invention, each of the inner insulating layer 310 and the outer insulating layer 330 may be formed by cross-winding kraft paper made of kraft pulp and impregnating the kraft paper with insulating oil. Thus, the insulating layer 310 and the outer insulating layer 330 may have lower resistivity and a higher dielectric constant than those of the intermediate insulating layer 320. The kraft paper may be prepared by removing organic electrolytes from the kraft pulp and cleaning the kraft pulp with deionized water to obtain a high dielectric tangent and a high dielectric constant.

The intermediate insulating layer 320 may be formed by cross-winding semi-synthetic paper a plastic film in which kraft paper is stacked on a surface, a back surface, or both of them and then impregnating the semi-synthetic paper with insulating oil. Because the intermediate insulating layer 320 formed as described above includes the plastic film, the intermediate insulating layer 320 has high resistivity, a low dielectric constant, a high DC dielectric strength and a high impulse breakdown voltage as compared with the inner insulating layer 310 and the outer insulating layer 330. The entire insulating layer 300 may be made compact by concentrating a DC electric field on the intermediate insulating layer 320 which is robust to DC internal electric field strength due to the high resistivity thereof and concentrating an impulse electric field on the intermediate insulating layer 320 which is robust to impulse electric field due to low dielectric constant thereof. Accordingly, an outer diameter of the cable may be decreased.

In the semi-synthetic paper used to form the intermediate insulating layer 320, the plastic film expands due to heat generated during the operation of the cable and thus oil resistance increases to suppress movement of the insulating oil impregnated in the insulating layer 300 to the outer semi-conductive layer 400. Thus, oiling voids may be suppressed from occurring due to the movement of the insulating oil, thereby suppressing concentration of an electric field and dielectric breakdown due to the deoiling voids. Here, the plastic film may be formed of polyolefin resin such as polyethylene, polypropylene or polybutylene, fluorine resin such as tetrafluoroethylene-hexafluoro polypropylene copolymer, ethylene-tetrafluoroethylene copolymer, and preferably, polypropylene homopolymer resin having high heat resistance.

A thickness of the plastic film may be 40 to 70% of the total thickness of the semi-synthetic paper. When the thickness of the plastic film is less than 40% of the total thickness of the semi-synthetic paper, the outer diameter of the cable may increase due to insufficient resistivity of the intermediate insulating layer 320. In contrast, when the thickness of the plastic film is greater than 70% of the total thickness of the semi-synthetic paper, the semi-synthetic paper may be difficult to process, i.e., prepare, may be difficult to be impregnated with the insulating oil due to insufficient distribution paths of insulating oil, and may be expensive.

A thickness of the inner insulating layer 310 may be 1 to 10% of the total thickness of the insulating layer 300, a thickness of the outer insulating layer 330 may be 5 to 15% of the total thickness of the insulating layer 300, and a thickness of the intermediate insulating layer 320 may be greater than or equal to 75% of the total thickness of the insulating layer 300. Thus, the maximum impulse electric field value of the inner insulating layer 310 may be lower than that of the intermediate insulating layer 320. When the thickness of the inner insulating layer 310 is increased more than necessary, the maximum impulse electric field value of the intermediate insulating layer 310 becomes greater than a permissible maximum impulse electric field value. In order to alleviate this problem, the outer diameter of the cable should be increased. It is preferable that the thickness of the outer insulating layer 330 be sufficiently larger than that of the inner insulating layer 310, as will be described below.

In addition, in the present invention, the inner insulating layer 310 and the outer insulating layer 330 having low resistivity are provided to suppress a high electric field of direct current from being applied directly onto the conductor 100 and directly below the metal sheath layer 500. Furthermore, the thickness of the intermediate insulating layer 320 having high resistivity is designed to be 75% or more and thus the outer diameter of the cable may be reduced while maintaining sufficient dielectric strength.

As described above, the thicknesses of the inner insulating layer 310, the intermediate insulating layer 320, and the outer insulating layer 330 of the insulating layer 300 may be precisely controlled to minimize the outer diameter of the cable while achieving desired dielectric strength of the insulating layer 300. In addition, electric fields of direct current and an impulse applied to the insulating layer 300 may be designed to be most effective internal electric fields, and high electric fields of direct current and an impulse may be suppressed from being applied directly onto the conductor 100 and directly below the metal sheath layer 500 to apply a design means to increase dielectric strength of a cable connection member, which is vulnerable to an electric field, to a sufficient level.

Preferably, the thickness of the outer insulating layer 330 is greater than that of the inner insulating layer 310. For example, in the case of a 500 kV DC cable, the inner insulating layer 310 may have a thickness of 0.1 to 2.0 mm, the outer insulating layer 330 may have a thickness of 0.1 to 3.0 mm, and the intermediate insulating layer 320 may have a thickness of 15 to 25 mm.

Heat generated during a lead-joining work for connection of the cable according to the present invention may be supplied to the insulating layer 300 and thus the plastic film of the semi-synthetic paper of the intermediate insulating layer 320 may be melted by the heat. Thus, in order to protect the plastic film from the heat, the outer insulating layer 330 should be formed to a sufficient thickness and is preferably thicker than the inner insulating layer 310. The thickness of the outer insulating layer 330 is preferably 1 to 30 times that of the inner insulating layer 310.

In addition, the thickness of a sheet of semi-synthetic paper used to form the intermediate insulating layer 320 may be 70 to 200 μm, and the thickness of kraft paper used to form the inner and outer insulating layers 310 and 320 may be 50 to 150 μm. The thickness of the kraft paper used to form the inner and outer insulating layers 310 and 320 may be less than that of the kraft paper of the semi-synthetic paper.

When the kraft paper used to form the inner and outer insulating layers 310 and 320 is extremely thin, mechanical damage may be caused due to insufficient strength of the kraft paper when the kraft paper is wound, and the number of cross-winding the kraft paper should be increased to form an insulating layer to a desired thickness, thereby reducing productivity of the cable. Furthermore, because total volume of gaps between parts of the wound kraft paper, which serve as a main passage of the insulating oil, decreases, it may take a long time to impregnate the kraft paper with the insulating oil, and the amount of the insulating oil impregnated in the kraft paper may decrease, making it difficult to achieve desired dielectric strength.

The insulating oil impregnated in the insulating layer 300 is fixed without being circulated in a lengthwise direction of the cable, similar to a low-viscosity insulating oil used in existing OF cables, and thus, an insulating oil having relatively high viscosity is used. The insulating oil may be used to not only achieve desired dielectric strength of the insulating layer 300 but also to function as a lubricant to facilitate the movement of the insulating paper when the cable is bent.

A type of the insulating oil is not particularly limited, but a medium-viscosity insulating oil having a kinematic viscosity of 5 to 500 centistokes (cSt) at 60° C. or a high-viscosity insulating oil having a kinematic viscosity of 500 centistokes (cSt) or more at 60° C. For example, at least one insulating oil selected from the group consisting of naphthenic insulating oil, polystyrene insulating oil, mineral oil, alkyl benzene or polybutene synthetic oil, heavy alkylate, and the like may be mixed and used.

A process of impregnating the insulating layer 300 with the insulating oil may be performed by cross-winding each of the kraft paper and the semi-synthetic paper a plurality of times to form the inner insulating layer 310, the intermediate insulating layer 320 and the outer insulating layer 330 to desired thicknesses, vacuum-drying these layers to remove residual moisture from the insulating layer 300, impregnating the insulating layer 300 with the insulating oil for a certain time by injecting into a tank the insulating oil heated to a high impregnation temperature, e.g., 100 to 120° C. under a high pressure environment, and gradually cooling the insulating oil.

The outer semi-conductive layer 400 suppresses a non-uniform electric field distribution between the insulating layer 300 and the metal sheath layer 500, alleviates the electric field distribution, and physically protects the insulating layer 300 from the metal sheath layer 500 which may have various shapes.

The outer semi-conductive layer 400 may be formed by cross-winding semi-conductive paper, such as carbon paper obtained by treating insulating paper with conductive carbon black, and may preferably include a lower layer formed by cross-winding the semi-conductive paper and an upper layer formed by gap-winding or overlap-winding the semi-conductive paper and metallized paper. Here, when the semi-conductive paper and the metallized paper of the upper layer are overlap-wound, the metallized paper and the semi-conductive paper may be alternately cross-wound such that certain portions, e.g., 20 to 80%, thereof overlap each other.

Here, the metallized paper may have a structure in which a metal foil such as aluminum tape or aluminum foil is stacked on base paper such as kraft paper or carbon paper. The metal foil may include a plurality of perforations via which insulating oil may easily penetrate into semi-conductive paper, insulating paper, semi-synthetic paper, etc. below the metal foil. Thus, the semi-conductive paper of the lower layer may be brought into smooth electrical contact with the metal foil of the metallized paper through the semi-conductive paper of the upper layer. As a result, the outer semi-conductive layer 400 and the metal sheath layer 500 may be brought into smooth electrical contact with each other and thus a uniform electric field distribution may be formed between the insulating layer 300 and the metal sheath layer 500.

In addition, a woven copper-wire fabric (not shown) may be additionally provided between the outer semi-conductive layer 400 and the metal sheath layer 500. The woven copper-wire fabric has a structure in which 2 to 8 strands of copper wire are directly inserted into a nonwoven fabric. Through the copper wire, the semi-conductive layer 400 and the metal sheath layer 500 may be brought into smooth electrical contact with each other. Additionally, the semi-conductive paper, the metallized paper, and the like which are wound to form the outer semi-conductive layer 400 may be firmly bound to maintain the above structure without being loosened, and the metallized paper and the like may be prevented from being damaged (e.g., being torn) due to the movement of the metal sheath layer 500 when the cable thermally contracts and thus is bent.

Figure 4:
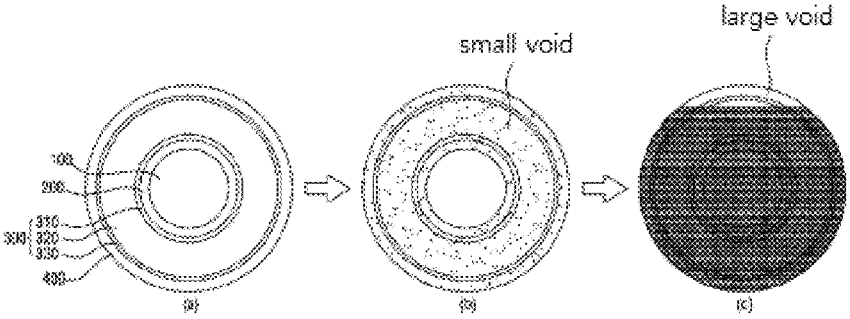
FIG. 4 schematically illustrates a process in which a large void occurs below a metal sheath layer when a power cable of the present invention is installed in a low-temperature environment after production.

FIG. 4 schematically illustrates a process in which a large void occurs below a metal sheath layer when a power cable of the present invention is installed in a low-temperature environment after production.

As illustrated in FIG. 4(*a*), an inner semi-conductive layer 200, an insulating layer 300, and an outer semi-conductive layer 400 are completely impregnated with an insulating oil immediately after the production of the cable. However, as illustrated in FIG. 4(*b*), when the cable is installed in a low temperature environment, the impregnated insulating oil may shrink due to a decrease in ambient temperature and thus a large number of small voids containing no insulating oil may occur in the inner semi-conductive layer 200, the insulating layer 300, and the outer semi-conductive layer 400. Furthermore, as illustrated in FIG. 4(*c*), when the installed cable is left at low temperatures for a long time until electric current is supplied thereto, a force may be applied to the impregnated insulating oil in the direction of gravity and thus the insulating oil may move to the bottom of the cable, thereby causing concentration of the small voids at the top of the cable to form a large void. As the viscosity of the insulating oil decreases, the insulating oil is more likely to move due to gravity and thus this problem may become worse. Therefore, this problem may be worse when a medium-viscosity insulating oil is used than when a high-viscosity insulating oil is used.

Furthermore, as illustrated in FIG. 4(*c*), when the generated large void extends to the insulating layer 300, an electric field may be concentrated in the large void in the insulating layer 300 and thus partial discharge, dielectric breakdown, or the like may occur therein, thereby shortening the lifespan of the cable.

In this situation, the present inventors have completed the present invention, based on a fact that even when the large void occurs due to precise control of the thickness of the outer semi-conductive layer 400, the large void can be controlled to extend to the outer semi-conductive layer on the insulating layer 300 other than the insulating layer 300, thereby effectively suppressing partial discharge, dielectric breakdown, and the like.

That is, the insulating oil impregnated in voids in the conductor 100, the semi-conductive layers 200 and 400, the insulating layer 300, etc. may shrink at low temperatures and thus a large number of small voids may occur. A thickness of the outer semi-conductive layer 400 is designed to be greater than that of an outer semi-conductive layer of a cable of a related art, so that a large void may occur only in the outer semi-conductive layer 400 other than in the insulating layer 300 when a large void occurs at the top of the cable due to downward movement of the insulating oil by gravity over time.

In detail, a criterion for designing the thickness of the outer semi-conductive layer 400 is closely related to porosity of each of the conductor 100, the inner semi-conductive layer 200, the insulating layer 300, and the outer semi-conductive layer 400 of the cable. Here, the porosity refers to a ratio of a total cross-sectional area or volume of voids to a total cross-sectional area or volume of each layer, and is a value, including porosity of a material of each layer and porosity due to gaps among kraft paper, semi-conductive paper and the like when they are cross-wound. Here, a total weight W1 of the insulating oil contained in the cable per unit length of 1 m may be expressed by Equation 1 below.

$$W1(\text{kg/m})=\rho\times S \qquad \text{[Equation 1]}$$

In Equation 1 above, ρ represents the density (kg/m$^3$) of the insulating oil at room temperature, S is {aA+bB+cC+dD+cE+bF}, a represents the porosity (%) of the conductor 100, b represents the porosity (%) of the inner semi-conductive layer 200 and the outer semi-conductive layer 400, c represents the porosity (%) of the porosity % of the inner insulating layer 310 and the outer insulating layer 330 of the insulating layer 300 which are formed by cross-winding kraft paper, and d represents the porosity % of the intermediate insulating layer 320 of the insulating layer 300 which is formed by cross-winding semi-synthetic paper.

A represents the cross-sectional area (m$^2$) of the conductor 100, B represents the cross-sectional area (m$^2$) of the inner semi-conductive layer 200, C represents the cross-sectional area (m$^2$) of the inner insulating layer 310, D represents the cross-sectional area (m$^2$) of the intermediate insulating layer 320, E represents the cross-sectional area (m$^2$) of the outer insulating layer 330, and F represents the cross-sectional area (m$^2$) of the outer semi-conductive layer 400.

The total content of the insulating oil impregnated per 1 m of an ultra-high voltage DC MIND cable of 400 kV or more is generally 1.0 to 2.5 kg/m. If insulating oil impregnated in the cable shrinks when the cable is installed in a low-temperature environment after production, the number of fine deoiling voids containing no insulating oil increases, and a relation between ambient temperature when the cable is installed and the total cross-sectional area A1 of the deoiling voids may be defined by Equation 2 below.

$$A1(\text{mm}^2)=\alpha\times\Delta T\times S \qquad \text{[Equation 2]}$$

In Equation 2 above, α represents an expansion rate (%) of the insulating oil, and ΔT represents the difference (° C.) between temperature at the time of production of the cable and the ambient temperature after installation.

Figure 5:
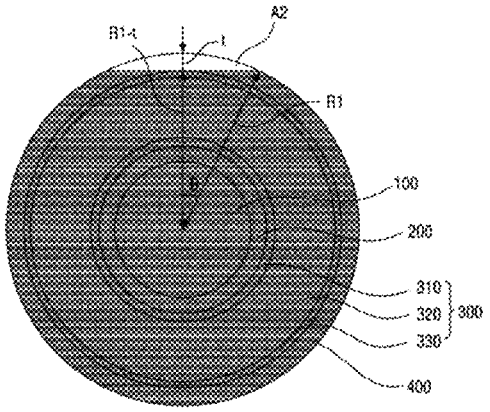
FIG. 5 is a reference diagram related to designing a thickness of an outer semi-conductive layer in a power cable according to the present invention.

FIG. 5 is a reference diagram related to designing a thickness of an outer semi-conductive layer in a power cable according to the present invention.

As illustrated in FIG. 5, an area A2 of the outer semi-conductive layer 400 required so that a large void may occur only in the outer semi-conductive layer 400 not in the insulating layer 300, caused when a large number of small voids occur due to shrinkage of an insulating oil impregnated in the cable after installation of the power cable in a low-temperature environment and are concentrated on the top of the cable due to downward movement of the insulating oil in the direction of gravity, may be defined by Equation 3 below.

$$\begin{aligned} A2(\text{mm}^2) &= \alpha\times\Delta T\times S/b \qquad \text{[Equation 3]}\\ &= 2\{(\prod\times R1^2\times\theta/360)-(R1-t)\times R1\times\sin\theta/2\}\\ &= 2\{(\prod\times R1^2\times\cos^{-1}\{(R1-t)/R1\}/360)-\\ &\quad (R1-t)\times R1\times\sin[\cos^{-1}\{(R1-t)/R1\}]/2\} \end{aligned}$$

In Equation 3 above, R1 represents an outer diameter (m) from the center of the conductor 100 to the outer semi-conductive layer 400, t represents the thickness (m) of the required area A2, and θ represents an angle (°) between the center of the required area A2 and one end thereof.

Based on Equations 1 to 3 above, a result of calculating the required area A2 in the outer semi-conductive layer 400 of a 500 kV ultra-high voltage cable having the specifications shown in Table 1 below and a thickness t of the required area A2 will be described below.

TABLE 1

| classification | outer diameter (mm) | cross-sectional area (mm$^2$) | porosity (%) |
|---|---|---|---|
| conductor | 58 | 2,642 | 5 |
| inner semi-conductive layer | 59 | 92 | 40 |
| inner insulating layer | 62 | 285 | 40 |
| intermediate insulating layer | 102 | 5,152 | 25 |
| outer insulating layer | 105 | 488 | 40 |
| outer semi-conductive layer | 108 | 502 | 40 |

In detail, when the total weight W1 of the insulating oil impregnated in the cable per unit length of 1 m is calculated by Equation 1, 926×{(0.05×2,642)+(0.4×92)+(0.4×285)+(0.25×5,152)+(0.4×488)+(0.4×166)+(0.4×167)+(0.4×169)}/(1E+6)=1.82 kg/m. Here, it is assumed that the density of the insulating oil at room temperature is 926 kg/m$^3$.

When a total cross-sectional area A1 of deoiling voids occurring in the outer semi-conductive layer after installation of the cable in a low-temperature environment is calculated by Equation 2, 0.00007×5×{(0.05×2,642)+(0.4×92)+(0.25×5,152)+(0.4×488)+(0.4×166)+(0.4×167)+(0.4×169)}=6.88 mm$^2$. Here, it is assumed that an expansion rate of the insulating oil is 0.0007% and ΔT is 5° C.

When the required area A2 of the outer semi-conductive layer is calculated by Equation 3, 6.88/0.4=17.2 mm$^2$. The thickness t of the required area A2 according to the required area A2 is calculated to be about 1.1 mm. The thickness t is about 4.4% of a thickness from the inner semi-conductive layer 200 to the outer semi-conductive layer 400, i.e., {108(outer diameter of outer semi-conductive layer)−58 (diameter of conductor)}/2=25 mm.

Through the above process, various types of cable structures were evaluated. In general, a cable is manufactured at a temperature of 25 to 45° C., an ambient temperature is about 5° C. when the cable is installed at the bottom of the sea and is about −10° C. when the cable is installed on the ground, and the difference in temperature between a production time and an installation time is about 20 to 50° C. The thickness t of the required area A2 of the outer semi-conductive layer may be 7.5 to 15% of the thickness from the inner semi-conductive layer 200 to the outer semi-conductive layer 400, based on these temperatures. For example, the thickness t may be 2 to 4 mm.

Here, when the thickness t is less than 7.5% of the thickness from the inner semi-conductive layer 200 to the outer semi-conductive layer 400, the large void may extend to the insulating layer 300 and thus partial discharge, dielectric breakdown, etc. may occur starting from the large void. When the thickness t is greater than 15% of the thickness from the inner semi-conductive layer 200 to the outer semi-conductive layer 400, a thickness of the outer semi-conductive layer 400 increases more than necessary, thereby increasing an outer diameter of the cable.

Due to the thickness of the outer semi-conductive layer 400 controlled precisely as described above, when the cable is left for a long time until overcurrent is applied thereto after installation in a low-temperature environment, a large void occurring at the top of the cable extends to the outer semi-conductive layer 400 not to the insulating layer 300, thereby effectively suppressing the occurrence of partial discharge and dielectric breakdown in the insulating layer.

Figure 6:
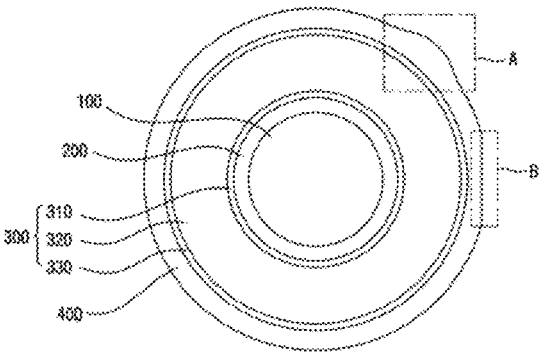
FIG. 6 schematically illustrates a deformed outer semi-conductive layer in a power cable according to an embodiment of the present invention.

FIG. 6 schematically illustrates a deformed outer semi-conductive layer in a power cable according to an embodiment of the present invention.

As illustrated in FIG. 6, in the cable, a thickness of the outer semi-conductive layer 400 is designed to be large to prevent deformation of the insulating layer 300 even when the outer semi-conductive layer 400 is deformed, e.g., the outer semi-conductive layer 400 locally protrudes (see 'A') or is locally depressed (see 'B'), due to external impact or pressure. Thus, dielectric breakdown due to electric field distortion or the like may be additionally prevented.

The metal sheath layer 500 prevents the insulating oil from leaking to the outside from the inside of the cable, functions as a return path of fault current when a grounding or short-circuit occurs in the cable by grounding an end of the cable by maintaining a voltage, which is applied to the cable during transmission of direct current, between the conductor 100 and the metal sheath layer 500, thereby securing safety, protects the cable from external impacts, pressure, etc., and improves watertightness, flame retardancy, etc. of the cable.

The metal sheath layer 500 may be, for example, a lead sheath formed of pure lead or a lead alloy. As the metal sheath layer 500, the lead sheath may also function as a high-current conductor owing to relatively low electrical resistance thereof, and may additionally improve watertightness, mechanical strength, fatigue characteristics, etc. of the cable, when formed as a seamless type.

Furthermore, a corrosion inhibiting compound, e.g., blown asphalt, may be applied on a surface of the lead sheath to additionally improve corrosion resistance, watertightness, etc. of the cable and improve adhesion between the metal sheath layer 500 and the cable protection layer 600.

The cable protection layer 600 may include, for example, a metal reinforcement layer 630 and an outer sheath 650, and may further include the inner sheath 610 and bedding layers 620 and 640 on and below the metal reinforcement layer 630. Here, the inner sheath 610 improves corrosion resistance, watertightness of the cable, and protects the cable from mechanical trauma, heat, fire, ultraviolet rays, insects or animals. The inner sheath 610 is not particularly limited but may be formed of polyethylene having excellent cold resistance, oil resistance, chemical resistance, etc., polyvinyl chloride having excellent chemical resistance, flame resistance, etc., or the like.

The metal reinforcing layer 630 protects the cable from mechanical stress, and may be formed of galvanized steel tape, stainless steel tape, or the like to prevent corrosion. A corrosion inhibiting compound may be applied to a surface of the galvanized steel tape. The bedding layers 620 and 640 on and below the metal reinforcement layer 630 may alleviate external impact or pressure, and may be formed, for example, using a nonwoven tape.

The metal reinforcement layer 630 may be provided directly on the metal sheath layer 500 or through the bedding layers 620 and 640. In this case, mechanical reliability of the cable may be improved by suppressing expansion and deformation of the metal sheath layer 500 due to expansion of the insulating oil in the metal reinforcement layer 630 at a high temperature, and at the same time, dielectric strength thereof may be improved by applying hydraulic pressure to portions of the insulating layer 300 and the semi-conductive layers 200 and 400 included in the metal sheath layer 500.

The outer sheath 650 has substantially the same function and characteristics as the inner sheath 610. An outer sheath of a cable used in a submarine tunnel, a terrestrial tunnel section, etc. may be formed of polyvinyl chloride having excellent flame retardancy, because fire is a risk factor that greatly affects manpower or equipment safety. An outer sheath of a cable used in a pipe conduct section may be formed of polyethylene having excellent mechanical strength and cold resistance.

Although not shown, the inner sheath 610 may be omitted and the metal reinforcement layer 630 may be directly installed on the metal sheath layer 500, and a bedding layer may be provided, as needed, inside and outside the metal reinforcement layer 630. That is, a bedding layer, a metal reinforcement layer, a bedding layer, and an outer sheath may be sequentially provided on an outer side of the metal sheath layer. In this case, it is preferable in terms of fatigue characteristics of the metal sheath layer 500 because the metal reinforcement layer 630 allows deformation of the metal sheath layer 500 but suppresses a change of an outer circumferential length thereof, a hydraulic pressure of the cable insulating layer 300 in the metal sheath layer 500 may be increased when electric power is supplied to the cable, a decrease in the hydraulic pressure, caused by contraction of the insulating oil due to a decrease in temperature of the cable when the supply of the electric current is stopped, may be compensated, and the insulating oil may be replenished by moving it from a part having a high hydraulic pressure to a part, e.g., the inner semi-conductive layer 200, in which a hydraulic pressure sharply decreases due to the difference between the hydraulic pressures.

In addition, when the cable is a submarine cable, the cable protection layer 600 may further include a wire sheath 660, an outer serving layer 670 formed of polypropylene yarn or the like, etc. The wire sheath 660 and the outer serving layer 670 may additionally protect the cable from sea currents, reefs, etc. at the sea bottom.

While the present invention has been described above with respect to exemplary embodiments thereof, it would be understood by those of ordinary skilled in the art that various changes and modifications may be made without departing from the technical conception and scope of the present invention defined in the following claims. Thus, it is clear that all modifications are included in the technical scope of the present invention as long as they include the components as claimed in the claims of the present invention.

The invention claimed is:

1. A power cable comprising:

a conductor;

an inner semi-conductive layer covering the conductor;

an insulating layer covering the inner semi-conductive layer, the insulating layer being impregnated with an insulating oil;

an outer semi-conductive layer covering the insulating layer;

a metal sheath layer covering the outer semi-conductive layer; and a cable protection layer covering the metal sheath layer, wherein the insulating layer is formed by cross-winding insulating paper and impregnating the insulating paper with the insulating oil, wherein the inner semi-conductive layer and the outer semi-conductive layer are formed by cross-winding semi-conductive paper and impregnating the semi-conductive paper with the insulating oil, and wherein a thickness of the outer semi-conductive layer is 7.5 to 15% of a total thickness of the inner semi-conductive layer, the insulating layer, and the outer semi-conductive layer.

2. The power cable of claim 1, wherein the thickness of the outer semi-conductive layer is 2 to 4 mm.

3. The power cable of claim 1, wherein the insulating oil comprises a medium-viscosity insulating oil having a kinematic viscosity of 5 to 500 centistokes (Cst) at 60° C.

4. The power cable of claim 1, wherein the insulating oil comprises a high-viscosity insulating oil having a kinematic viscosity of 500 centistokes (Cst) or more at 60° C.

5. The power cable of claim 1, wherein the outer semi-conductive layer comprises:

a lower layer formed by cross-winding the semi-conductive paper; and an upper layer formed by overlap-winding the semi-conductive paper and metallized paper.

6. The power cable of claim 1, wherein the outer semi-conductive layer further comprises an uppermost layer formed of woven copper-wire fabric.

7. The power cable of claim 1, wherein the insulating layer is formed by sequentially stacking an inner insulating layer, an intermediate insulating layer, and an outer insulating layer, the insulating layer being formed by cross-winding either kraft paper or semi-synthetic paper including a plastic film and kraft paper stacked on at least one side of the plastic film, a thickness of the inner insulating layer is 1 to 10%, a thickness of the intermediate insulating layer is 75% or more, and a thickness of the outer insulating layer is 5 to 15%, based on a total thickness of the insulating layer, and resistivities of both of the inner insulating layer and the outer insulating layer are less than resistivity of the intermediate insulating layer.

8. The power cable of claim 7, wherein the thickness of the outer insulating layer is greater than the thickness of the inner insulating layer.

9. The power cable of claim 7, wherein the thickness of the outer insulating layer is 1 to 15 times the thickness of the inner insulating layer.

10. The power cable of claim 1, wherein the plastic film is formed of a polypropylene homopolymer resin.

11. The power cable of claim 7, wherein a thickness of the kraft paper of the inner insulating layer and a thickness of the kraft paper of the outer insulating layer are less than a thickness of the kraft paper of the semi-synthetic paper.

12. The power cable of claim 7, wherein a maximum impulse electric field value of the inner insulating layer is less than that of the intermediate insulating layer.

13. The power cable of claim 7, wherein a maximum impulse electric field value of the intermediate insulating layer is 100 kV/mm or less.

14. The power cable of claim 7, wherein a thickness of the plastic film is 40 to 70% of a total thickness of the semi-synthetic paper.

15. The power cable of claim 14, wherein the thickness of the semi-synthetic paper is 70 to 200 μm, and a thickness of kraft paper of the inner insulating layer and the outer insulating layer is 50 to 150 μm.

16. The power cable of claim 1, wherein the conductor is formed of annealed copper wire or aluminum, and comprises either a flat conductor formed by stacking flat element wires in multiple layers on a round center wire or a circularly compressed conductor formed by stacking and compressing round element wires in multiple layers on a round center wire.

* * * * *